United States Patent [19]

Haimson

[11] Patent Number: 4,713,581

[45] Date of Patent: Dec. 15, 1987

[54] METHOD AND APPARATUS FOR ACCELERATING A PARTICLE BEAM

[75] Inventor: Jacob Haimson, Mountain View, Calif.

[73] Assignee: Haimson Research Corporation, Palo Alto, Calif.

[21] Appl. No.: 811,236

[22] Filed: Dec. 20, 1985

Related U.S. Application Data

[63] Continuation of Ser. No. 521,522, Aug. 9, 1983, abandoned.

[51] Int. Cl.[4] ..... H01J 25/10

[52] U.S. Cl. ..... 315/5.41; 315/5.42; 250/266; 250/269; 328/233

[58] Field of Search ..... 315/5.41, 5.42; 250/266, 269; 328/233, 234

[56] References Cited

U.S. PATENT DOCUMENTS

| | | | |
|---|---|---|---|
| 2,698,381 | 12/1954 | Harvie | 315/5.42 X |
| 2,813,996 | 11/1957 | Chodorow | 315/5.42 |
| 2,887,580 | 5/1959 | Bischoff | 315/5.42 X |
| 2,899,598 | 8/1959 | Ginzton | 315/5.42 X |
| 2,925,522 | 2/1960 | Kelliher | 315/5.42 |
| 3,450,931 | 6/1969 | Feinstein et al. | 315/5.42 X |
| 4,093,854 | 6/1978 | Turcotte et al. | 250/269 |
| 4,118,653 | 10/1978 | Vaguine | 315/5.41 |
| 4,146,817 | 3/1979 | McEuen et al. | 315/5.41 |

FOREIGN PATENT DOCUMENTS

| | | | |
|---|---|---|---|
| 0665998 | 2/1952 | United Kingdom | 315/5.42 |

*Primary Examiner*—Saxfield Chatmon

*Attorney, Agent, or Firm*—Limbach, Limbach & Sutton

[57] ABSTRACT

A travelling wave resonant ring accelerator method and apparatus is disclosed which includes a generator of radio frequency source energy and a low dispersion accelerator waveguide interconnected by a microwave bridge network that combines said source energy and said accelerator remnant energy and directs said combined energy to the input of the accelerator waveguide under desired conditions with the bridge balanced. The method and apparatus simultaneously maintain (a) the optimum beam-wave phase relationship in the accelerator waveguide and (b) the correct electrical length of the resonant ring, regardless of wide variations in ambient temperature, by maintaining a balanced bridge condition by automatically adjusting the frequency of the source energy. Electromagnetic interference is avoided by incorporating a high power modulator high voltage switch in a compact coaxial transmission line to provide a contraflow circuit for high current pulses switched and transmitted between a pulse forming network and a pulse transformer. Also disclosed is a fluid-tight dual housing arrangement utilizing a high voltage coaxial connector assembly which includes multiple sliding contacts, between inner and outer conductors of matched individual coaxial transmission lines in each housing, to maintain stress-free electrical connections when large differential longitudinal movements take place between the housings and the accelerator equipment contained therein.

32 Claims, 15 Drawing Figures

METHOD AND APPARATUS FOR ACCELERATING A PARTICLE BEAM

This is a continuation of applicaation Ser. No. 521522 filed Aug. 9th 1983, now abandoned.

TECHNICAL FIELD

The present invention is directed in general to particle accelerator method and apparatus and more particularly to a travelling wave resonant ring accelerator system that provides a highly stable, narrow spectrum electron beam for far distant remote operation in a high temperature and restricted space environment and with a limited level of available input power.

BACKGROUND ART

Travelling wave linear accelerators have been disclosed in the past wherein feedback of the remnant RF power from the output of the linear accelerator is combined in suitable phase relationship with input power from the RF source using an RF bridge. With proper phase conditions, the RF power entering the accelerator can be increased above that available from the source by a factor which depends upon the total attenuation in the feedback loop and upon the RF bridge ratio. Such systems are disclosed by R. B. R. Shersby-Harvie and L. B. Mullett in "A Travelling Wave Linear Accelerator With R.F. Power Feedback, and An Observation of R.F. Absorption by Gas in Presence of a Magnetic Field," Proceedings of the Physical Society, pages 270–271, Feb. 3, 1949, and P. M. Lapostolle and A. L. Septier, "Linear Accelerators," North-Holland Publishing Company, Amsterdam, pages 56–60 (1970).

A variety of RF bridge circuits, suitable for this feedback application, include coaxial and waveguide hybrid junctions, short branch couplers, coaxial and waveguide hybrid rings, etc., each of which can be represented as an eight terminal network arranged so that the following specific conditions are satisfied. Assuming four transmission lines connected to an RF bridge, as shown in FIG. 1, (a) arms 1 and 3 should be independently matched to the bridge when arms 2 and 4 are terminated by their characteristic impedances; (b) a high degree of isolation should exist between arms 1 and 2 so that power fed into either arm 1 or arm 3 is transmitted to loads in arms 2 and 4 only; (c) conversely, arms 2 and 4 should be balanced with respect to each other so that RF power entering either arm is delivered to loads at arms 1 and 3 only; and (d) there should be no power circulating within the bridge.

Typical prior application of the RF feedback principle is shown schematically in FIG. 2. Power, $P_1$, from an external source is combined with correctly phased remnant power, $P_3$, from the accelerator so that, after an initial transient build-up period, a steady state power level of $P_2=(1+n)P_1$ appears at the input to the accelerator. The bridge ratio, n, is defined as the ratio of RF powers that the bridge is designed to combine. When source power is applied to the system, it is shared initially between the accelerator and load arms; and after one recirculation through the accelerator, for a unity ratio bridge and a 3 dB loss in in the feedback loop, and with correct phasing, the accelerator input power will increase to 112.5 percent of the source power, while power to the load will be reduced to 12.5 percent of the source power. The accelerator input power will continue to build up with each recirculation; and after five traversals of the feedback loop, the input power will be 194 percent of the source power (97 percent of the steady state value). The time for each RF transit is determined primarily by the group velocity of the accelerator structure. At completion of the build-up process, the accelerator input power level will be double that of the source, while the power in the load arm will be reduced to zero, as shown in FIG. 3. The mutually conjugate properties of the bridge arms 1 and 3 ensure that even during the RF build-up process, a constant impedance is presented to the external RF source.

With RF recirculation techniques, the stability of the accelerator input power depends critically on maintaining a specific phase relationship between the feedback power and the source power, i.e., the overall electrical length of the feedback loop must be maintained at a constant "resonant" value. Thus, phase changes in the feedback loop, caused either by changes in temperature of the accelerator structure or by departures from the correct operating frequency, result in a loss of input power to the accelerator and, therefore, a change in beam performance.

In prior accelerator feedback applications, the power level at the input to the accelerator was monitored so that the loss of RF buildup, due to a change in phase of the feedback loop, could be detected and corrected by adjustment of a high power RF phase shifter located in the accelerator feedback arm, as shown in FIG. 2. It should be noted that, although adjustment of this external phase shifter can maintain the total electrical length of the feedback loop at the correct resonant value, by compensating for temperature or frequency related phase changes of the accelerator waveguide, the phase slip error between the electron beam and the accelerating RF field within the wavequide remains uncorrected.

Travelling wave resonant ring accelerators were successfully demonstrated on a commercial basis during the early 1950's when the first linear accelerator systems developed specifically for megavoltage radiotherapy were placed into clinical service. These early accelerators were RF energized by a 2 MW wartime developed radar magnetron; and to greatly simplify patient setup procedures and ensure accuracy, the accelerators were isocentrically mounted (Howard-Flanders, P., and Newberry, G. R., 1950, Brit. J. Radiol., 23, 355). Since rotation of the accelerator around the patient was one of the tri-axii conditions of the isocentric mounting and because the magnetron frequency stability was known to be marginal, the early radiotherapy accelerators proved to be excellent candidates for RF feedback because the frequency sensitivity and the length of the accelerator waveguide could be reduced to provide a more compact and maneuverable system, while still achieving the desired 4 MeV loaded beam energy. With the advent of the tunable magnetron, with use of AFC controls and beam bending techniques, and with the subsequent development of a new design travelling wave structure, RF feedback systems were no longer required for the construction of compact radiotherapy accelerators (Haimson, J. and Karzmark, C. J., 1963, Brit. J. Radiol., 36, 429).

Apart from clinical applications, compact linear accelerator systems can be effectively employed for industrial radiography and other specialized uses requiring the production and application of megavoltage beams of radiation within a restricted space environment. One such specialized application is the logging of earth formations in which a temperature hardened linear accelerator system, suspended in a borehole, is used to generate a stable high energy electron beam for creating radiation, the interaction effects of which can be analyzed to determine the character and constituents of the earth formations penetrated by the borehole.

Well-logging applications impose severe restrictions on the design of an electron linear accelerator. These restrictions are due to the small transverse dimensions of the pressure housing containing the accelerator equipment (typically 5 inches or less), the low level of available input power (typically less than 1 kW) due to the long borehole logging cable, and the high temperatures encountered during operation (such as 100 to 200° C.). In comparison with prior linear accelerator applications, these design restrictions are unique and should be considered together with the requirement that the borehole accelerator system be operated over distances which may extend to approximately 20,000 feet.

While the design constraints of a borehole linear accelerator system are necessarily severe, the output radiation intensity and energy can be substantially greater than that of the chemical radioactive sources used for existing logging services. Thus, in comparison with a standard cesium well logging radioactive source, a borehole linear accelerator having orders of magnitude greater radiation output, with average and peak photon energies in the megavoltage range, permits measurements of greater statistical precision and permits greater depths of investigation of the geological formation surrounding the borehole. Highly stable and accurately reproducible electron energy characteristics and a low level of electromagnetic interference are additional desirable features which allow simpler and more accurate measurement analysis techniques.

Attempts to overcome the aforementioned restrictions are generally described in U.S. Pat. No. 3,061,725 issued Oct. 30, 1962, to J. Green entitled "Comparison Logging of Geologic Formation Constituents" and U.S. Pat. No. 3,976,879 issued Aug. 24, 1976, to R. Turcotte and entitled "Well Logging Method and Apparatus Using a Continuous Energy Spectrum Proton Source." Because of extreme temperature environments encountered in boreholes, efforts have been made to design cooling and control systems to stabilize the linear accelerator performance. U.S. Pat. No. 4,163,901 issued Aug. 7, 1979, to G. Azam, et al., entitled "Compact Irradiation Apparatus Using a Linear Charged-Particle Accelerator" discloses a particular cooling system inside the housing for the accelerator, particularly for cooling the magnetron RF power source for the linear accelerator disclosed therein. U.S. Pat. No. 4,093,854 issued June 6, 1978, to R. Turcotte, et al., entitled "Well Logging Sonde Including a Linear Particle Accelerator" discloses a standing wave type particle linear accelerator excited by a magnetron oscillator and provided with means to sense variations in the temperature of the accelerator and to adjust the frequency of the magnetron so as to compensate for accelerator resonant frequency variations resulting from temperature induced changes in the dimensions of the accelerator waveguide. This patent also discloses means to sense the variations in the amplitude of the microwave field in the accelerator and to control the frequency of the microwave generator so as to maintain the amplitude of the accelerating field at a reference value representative of the expected maximum amplitude value at resonance. It will be appreciated that the linear accelerators of the Azam et al. and Turcott et al. patents require complex and sensitive measuring devices and controls to provide a useful beam.

Notwithstanding the required controls, these last two mentioned patents do not address the problem of electromagnetic interference (EMI). The geometric constraints of a small diameter cylindrical housing present a unique and potentially serious EMI problem for a borehole linear accelerator because of the necessity to operate low level, relatively sensitive electronics in close proximity to modulator components that are being pulsed at a peak power level of several megawatts. Thus, the interconnecting cables (between power supplies and circuits controlling timing, protection, diagnostic and detection functions) running alongside the pulse forming network (PFN) and the high voltage switch, are susceptible to conductively coupled noise caused by radiated electric and magnetic fields. Coupled noise presents a major problem in the vicinity of a pulsed, fast rise time, high power switch tube. As is well known in modulator art, the HV switch tube enables energy stored in the PFN to be rapidly transferred to a step-up pulse transformer, thereby applying HV video pulses to the cathodes of the RF generator and accelerator gun. For example, in one embodiment of a borehole accelerator modulator, a pulse current of 500 amperes is switched through the primary winding of the pulse transformer for a period of several microseconds.

In addressing the problems of low available power, restricted transverse dimensions, high operating temperature and EMI, applicant has discovered a unique system which provides a very stable form of acceleration and a simple method of using same wherein a megavoltage particle beam is achieved with an accelerator of short length and small diameter and which will produce constant energy particles over a wide temperature range, without EMI interference, without the need to sense the temperature of microwave components, without moving parts, and with restricted input power. This apparatus and method can be achieved without cooling of the RF power source or accelerator structure and without the need for a beam focusing solenoid around the accelerator waveguide.

DISCLOSURE OF THE INVENTION

An object of the present invention is to provide a method and apparatus for maintaining a highly stable accelerated particle beam using a travelling wave resonant ring apparatus wherein a portion of the radio frequency energy which is fed into the accelerator is extracted and fed back through an RF bridge for reintroduction into the accelerator at a phase relationship that maintains optimum beam performance.

Another object of the present invention is to accomplish the aforementioned method and apparatus with a compact structure that will fit within the borehole of an oilwell.

Another object of the present invention is to provide a borehole logging method and apparatus with a particle accelerator system constructed for operation at a free floating temperature independent of any external cooling system.

Another object of the present invention is to achieve the method and apparatus of the principal object in a compact structure while minimizing electromagnetic interference effects in sensitive circuits and cables lying in very close proximity to. high power pulsed apparatus.

Still another object of the present invention is the packaging of the overall accelerator system in two interconnected modules by arranging for the hiqh power video pulse to be transmitted between modules via matched transmission lines terminated at the module interface by a moisture resistant, high current HV quick disconnect, coaxial, shielded connector designed for high temperature operation.

Broadly stated, the present invention, to be described in greater detail below, comprises a method and apparatus wherein an RF bridge network is provided for introducing energy from the source in one arm, for introducing remnant energy from the output of the accelerator in another arm, for directing the source energy and the accelerator remnant energy to the input if the accelerator in yet another arm, and for directing imbalance energy to an RF monitor and load in a fourth arm. The frequency of the source energy is automatically adjusted to maintain the detected imbalance energy in the fourth arm at a minimum.

When the accelerator remnant power is correctly phased with respect to the source power, the accelerator input RF power is maximized, the bridge is balanced, and the RF power level in the fourth (load) arm is reduced to essentially zero. Should a phase error, due to any cause, be introduced into the feedback loop, the bridge will become unbalanced, causing the accelerator input power to be reduced, and causing out-of-balance RF power to build up in the fourth arm. The amplitude of this out-of-balance RF power is strictly related to the magnitude of the phase error of the feedback loop and is easily detected by an RF monitor positioned in the fourth arm between the bridge and the RF load. This detected imbalance of the bridge is used to correct the overall electrical length of the resonant ring feedback loop by adjusting the frequency of the RF source until the RF power entering the fourth arm is reduced to essentially zero.

An advantage of the present invention is that correct resonant conditions for both the accelerator waveguide and the resonant ring feedback loop are maintained simultaneously. A simple automatic phase lock means is provided to accurately hold constant the electrical length of the accelerator waveguide and the feedback loop regardless of extremely wide variations in ambient temperature (>100° C.) without the use of an adjustable RF phase shifter or the need for RF phase or power measurements around the feedback loop and without the need for temperature sensing or temperature control of the resonant ring accelerator or the high power RF source.

In accordance with another aspect of the present invention, a metal enclosure surrounds the HV switch and acts as the outer conductor of a coaxial transmission line which provides a contraflow circuit for the high current pulses that are switched and transmitted between the PFN and the pulse transformer via the inner conductor of such coaxial transmission line. In this manner, the reverse current flowing through the enclosure surrounding the HV switch creates a magnetic field which opposes and cancels that generated within the HV switch and provides an EMI neutralized zone for the interconnecting cables.

Yet another aspect of the present invention is the incorporation of a double ended, multiple sliding joint HV coaxial connector, designed for transmission of high peak power video pulses. This enables the borehole accelerator to be dismantled at a field joint, thereby providing a convenient means for transportation and assembly of the system in the field. Such field joint HV coaxial connector components are arranged not only to provide a quick disconnect capability and to withstand the severe environmental conditions encountered in service but also to maintain stress-free electrical connections when substantial changes occur to the internal longitudinal dimensions of the sonde during logging operations in a high ambient temperature environment.

These features and advantages of the present invention will become more apparent upon examining the following specification, taken in conjunction with the accompanying drawings wherein similar characters of reference are referred to in similar elements in each of the several views.

DESCRIPTION OF THE PREFERRED EMBODIMENT

Figure 4A:
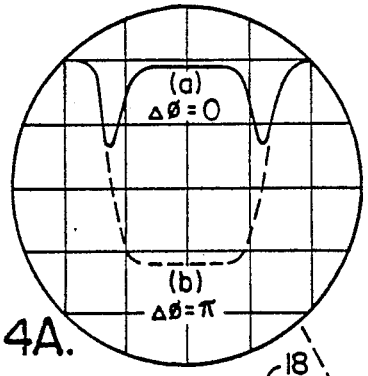
FIG. 4A shows the video signal waveform from the RF monitor in FIG. 4.
Figure 4:
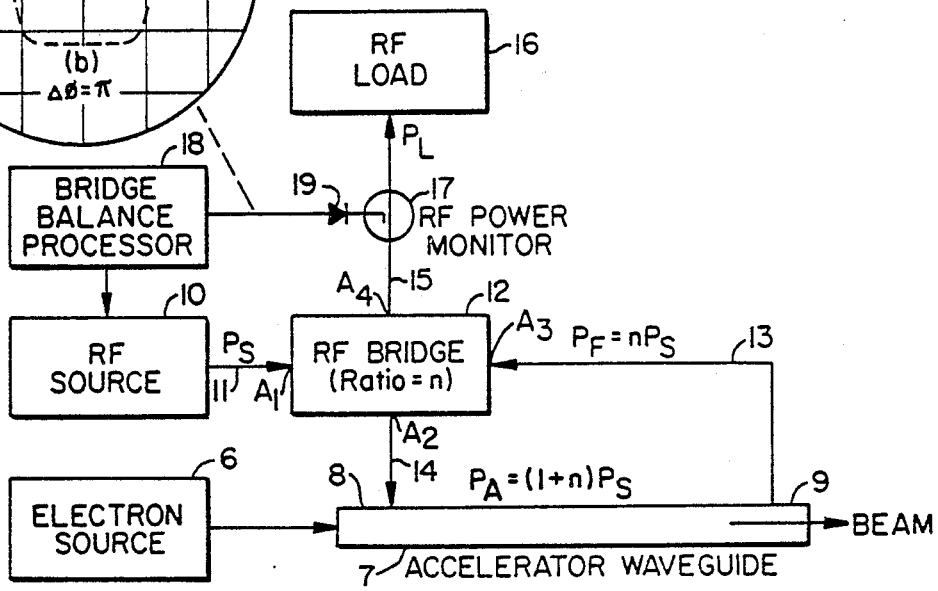
FIG. 4 is a schematic block diagram view illustrating the construction and operation of the present invention.

A schematic representation of the present invention is shown in FIG. 4.

A particle source such as an electron gun 6 directs a particle beam along an accelerator waveguide 7, from an input end 8 to an output end 9 so that an accelerated beam of particles emerges at the output end 9 of the accelerator. An RF power source 10 is connected, such as via waveguide 11, to a first arm $A_1$ of an RF bridge network 12. Remnant RF energy from the output end 9 of the accelerator waveguide is directed, such as via a waveguide 13, to a third arm $A_3$ of the RF bridge 12. The energy from arms $A_1$ and $A_3$ is directed via a second arm $A_2$ of the bridge 12 via waveguide 14 to the input end 8 of the accelerator waveguide 7. Imbalance energy in the bridge network is directed in a fourth arm $A_4$ via a waveguide 15 to an RF load 16. This imbalance energy is detected with an RF power monitor 17 which provides an input signal to the bridge balance processor 18 which in turn controls the frequency of the RF source 10.

When correctly phased remnant power, $P_F$, from the accelerator, is combined with the source power, $P_S$, using a bridge ratio of n, a power buildup will occur at the accelerator input such that $P_A=(1+n)P_S$, and the load power, $P_L$, will be reduced to zero. The pulsed waveform (a) shown in FIG. 4A indicates this balance condition as recorded by the video signal from the RF monitor 17 in the load arm $A_4$. If PF is not correctly phased with respect to $P_S$, the bridge 12 will be in an unbalanced condition, the accelerator input power will be reduced, and RF power will be directed into the load arm $A_4$. The bridge balance processor 18 derives a video signal from the diode detector 19 monitoring the power level in the load arm, and provides a control voltage that alters the frequency of the RF source 10 until the power entering the load arm $A_4$ is reduced to essentially zero, and the bridge 12 is thereby restored to the balanced condition. That is, the monitor signal from the bridge load arm is used to control the system frequency so that the level of imbalance RF power is always driven toward, or maintained at, a minimum. Because this technique enables the frequency to be automatically and rapidly tuned, highly stable operation of the resonant ring accelerator can be maintained regardless of transient phase disturbances within the system.

With a bridge ratio of unity, a total loop loss ($\alpha$) of 3 dB and a constant power RF source, the accelerator input power level and the load arm power level will pass through successive maxima and minima as the total electrical lenqth of the feedback loop is adjusted over a wide ranqe. These power level variations are shown plotted in FIG. 5 for feedback phase variations of $2\pi$ on each side of the operating phase position ($\phi=2m\pi$) for achieving optimum performance of the accelerator. With the resonant ring travelling wave linear accelerator described herein, the integer number of wavelengths, m, around the total feedback loop is established uniquely, for any given temperature, by the specific operating frequency that provides the desired optimum beam performance.

Figure 1:
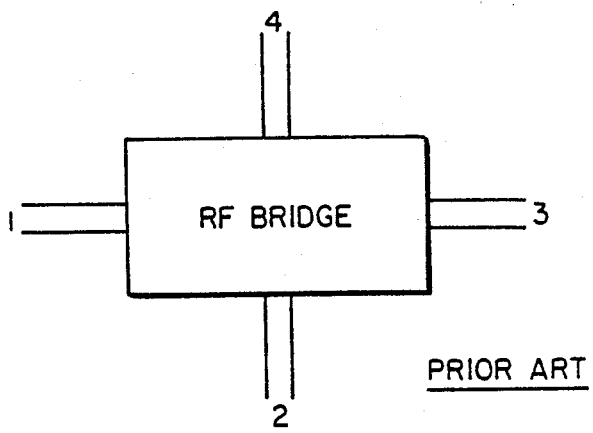
FIG. 1, as has been referred to hereinabove, is a schematic block diagram view representative of a bridge network used in the prior art.
Figure 2:
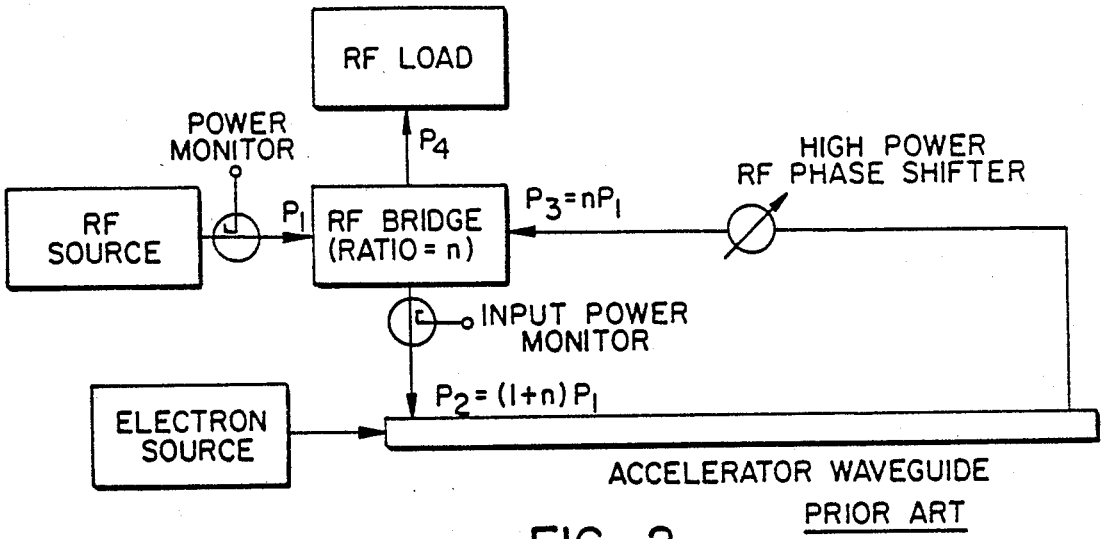
FIG. 2, as referred to hereinabove, is a schematic block diagram view of accelerator systems in accordance with the prior art.
Figure 3:
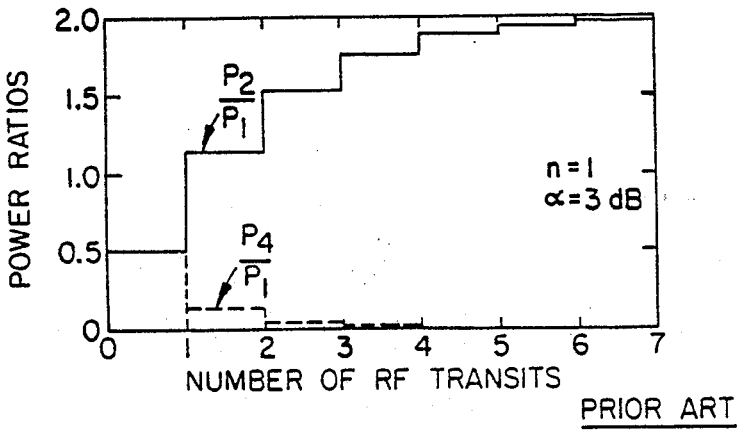
FIG. 3 is a graph of number of transits plotted against power ratios to show how accelerator input power builds up in prior art devices and the device in accordance with the present invention.
Figure 5:
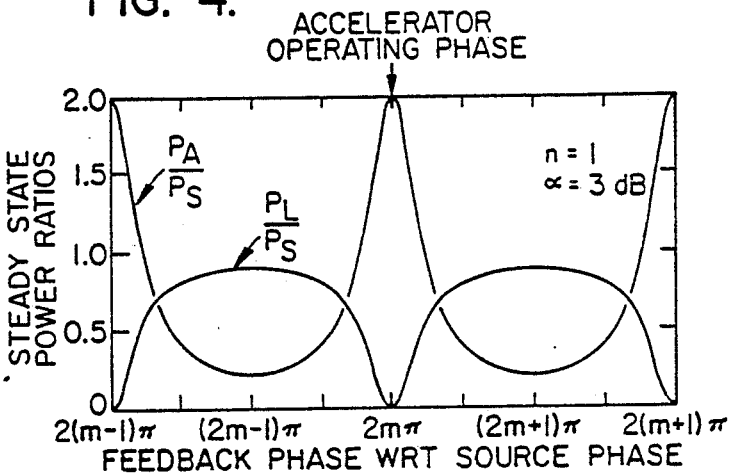
FIG. 5 is a graph of steady state power ratios plotted against feedback phase with respect to source phase illustrating the operation of the present invention.

The use of relatively broad band waveguide and coupler components within the feedback loop satisfies an important requirement to minimize reflections within the loop and allows exploitation of the FIG. 5 characteristics to provide a further practical advantage of the above described system. Namely, the pulse performance characteristics of the RF power source, connected to the first arm of the bridge, may be conveniently observed with the RF load monitor located in the fourth arm, by simply adjusting the system frequency until the diode detector signal is maximized, i.e., until the feedback loop phase length is made equal to $(2m\pm1)\pi$. The pulsed waveform (b) illustrated in FIG. 4A shows a typical video signal as derived from the RF monitor in the load arm for this frequency induced, $\pi$ phase shift condition of the feedback loop. Parenthetically, it should be noted that for the resonant ring accelerator parameters discussed above, the load arm power level has a maximum theoretical value of 8/9 of the actual power entering the bridge from the RF source, and the accelerator input power level is 2/9 of the source power. In practice, although these values are modified slightly, due to an effective reduction of loop loss caused by back-phasing of the beam in the accelerator waveguide, the load arm RF monitor provides an accurate and convenient means of confirming the performance of the RF source. This confirmation is an operational and servicing advantage that is made available without the need for an RF monitor in the first arm of the bridge, as was previously required. (Refer FIG. 2.)

In accordance with yet another aspect of the present invention, the accelerator waveguide, the RF bridge and the transmission lines are rigidly interconnected and assembled in very close proximity to one another so that, within the feedback loop, the average temperatures of the RF components remain approximately equal, regardless of ambient temperature or duty factor variations. With such an arrangement and in accordance with the present invention, once established during initial construction, both the overall electrical length of the feedback loop and the beam-wave phase relationship in the accelerator waveguide are maintained essentially constant, as described below, even when the uncooled accelerator system is operated remotely in a far distant high temperature environment.

The feedback loop total phase error, $\Delta\phi$, for any given operational or environmental change, will comprise phase error contributions from the different microwave components within the loop. If each of these components experiences an identical temperature change, then a single adjustment of the operating frequency will simultaneously correct all of the component phase errors, and the bridge will be restored to a balanced condition. Clearly, under these ideal conditions, correction of the loop total phase error results in restoration of the overall electrical length of the accelerator waveguide, as well as the input power level, thereby causing the beam-wave phase relationship to be re-established.

In practice, however, even when all of the feedback loop components are carefully integrated and in close thermal communication, it can be anticipated that under certain operating conditions small differences in temperature will develop between, say, the accelerator waveguide and the interconnecting transmission lines (and components) comprising the remainder of the feedback loop. Maintaining a balanced bridge condition by frequency adjustment is not affected by these intra-loop temperature gradients, but such gradients can introduce small phase errors into the accelerator structure. The magnitude of these phase errors is a function of the intra-loop temperature difference, and the phase dispersion characteristics of both the accelerator structure and the external interconnecting waveguide forming the remainder of the feedback loop.

Because of the typically adopted values of group velocity and reduced waveguide wavelength, travelling wave resonant ring accelerator structures have phase-frequency (or phase-temperature) sensitivities approximately 15 to 50 times greater than the interconnecting waveguide comprising the remainder of the feedback loop. As a consequence, the accelerator structure typically contributes greater than 90 percent of the total phase error developed in the feedback loop—an important feature that explains the effectiveness of frequency control in phase locking the feedback loop.

When an intra-loop temperature difference is developed by, say, the accelerator structure heating faster than the interconnecting waveguide, the bridge will be maintained in a balanced condition by an automatic reduction in frequency somewhat less than would have occurred with a uniformly heated (higher temperature) interconnecting waveguide. Thus, the accelerator will be operating at a frequency slightly higher than that required for maintaining a constant beam-wave phase relationship, i.e., the overall phase length of the accelerator structure will be slightly greater than desired. The beam-wave phase error introduced under these conditions is given by the product of the average temperature difference between the accelerator and interconnecting waveguides, the phase-temperature coefficient of the interconnecting waveguide network, and the fraction of the total loop phase error contributed by the accelerator waveguide under uniformly heated operating conditions. Symbolically, this can be written $$\Delta\theta = \Delta\overline{T}\left(\frac{\partial\phi_R}{\partial T}\right)\left(\frac{\partial\phi_C}{\partial\phi_C + \partial\phi_R}\right)_T$$

For example, accelerator structures and associated interconnecting waveguide networks typically incorporated in travelling wave resonant ring systems have phase-temperature characteristics that range from approximately 6 to 3 degrees/°C., and 0.1 to 0.2 degrees/°C., respectively, over a range of increasing values of ooerating frequency. Thus, to hold the overall electrical length of the accelerator structure constant to, say, ±2° phase (an operating condition that results in a highly stable beam-wave phase relationship) and using the above midrange values, the maximum temperature difference that can be permitted between the accelerator and interconnecting waveguides is given by $$2/[0.15(4.5/4.65)] = \pm 14^\circ \text{ C.},$$

a condition that can be readily achieved in practice by using high thermal conductivity materials and adopting the compact assembly technique described above. Consequently, for a constant RF input power, achievement of a highly stable and reproducible beam performance is limited essentially by the phase sensitivity and response of the bridge balancing system and not by the wide temperature variations encountered during the borehole logging operation.

Figure 6:
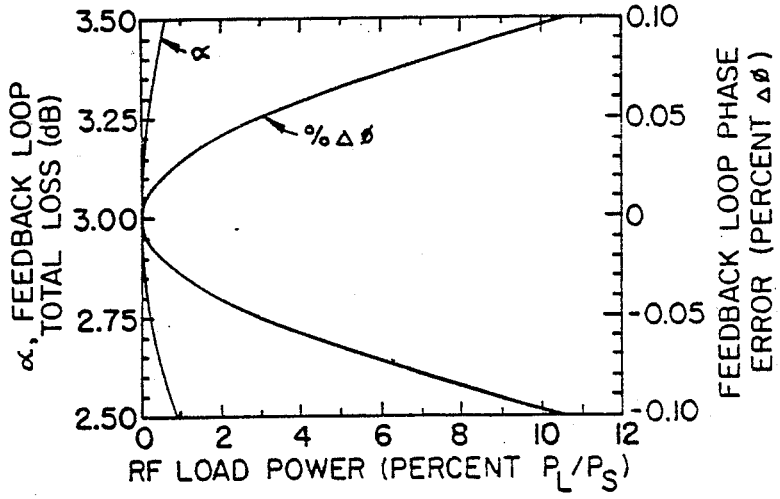
FIG. 6 is a graph of feedback loop loss and phase error plotted against RF load power.

The phase discriminating effectiveness of a correctly compensated and balanced RF bridge used in conjunction with a resonant ring borehole accelerator is shown plotted in FIG. 6. This data illustrates how the imbalance RF power in the load arm responds to very small phase changes between the accelerator remnant power and the source power, referred to the input ports of the bridge. For example, a phase change $\Delta\alpha$ of only two parts in $10^4$, typically representing two or three degrees over the total length of the feedback loop, results in a readily detectable growth of the imbalance power (to approximately ½ percent of the source power), with subsequent automatic correction by a small change in frequency. The FIG. 6 data reveals another important operational feature; namely, a ½ dB variation of the feedback loop 3 dB nominal attenuation ($\alpha$) has a negligible effect on the bridge balance offset level. Thus, the ability to accurately detect small phase changes in the feedback loop is unaffected by variations of the remnant power level caused, for example, by the change in resistivity of the accelerator waveguide at high ambient temperatures, or by operating at different beam loading conditions.

While the present invention is applicable to the construction and operation of linear accelerators in a wide variety of configurations and for a wide variety of applications, it is ideally suited for linear accelerators to be used in the borehole of an oil well for the logging of earth formations where the environmental conditions vary over a wide range. In addition, the apparatus in accordance with the present invention can fit within a minimum space and yet provide a particle beam having an energy typically greater than 3 MeV. Accordingly, the invention will be described for purposes of illustration specifically applicable to such a particle accelerating device.

Figure 7:
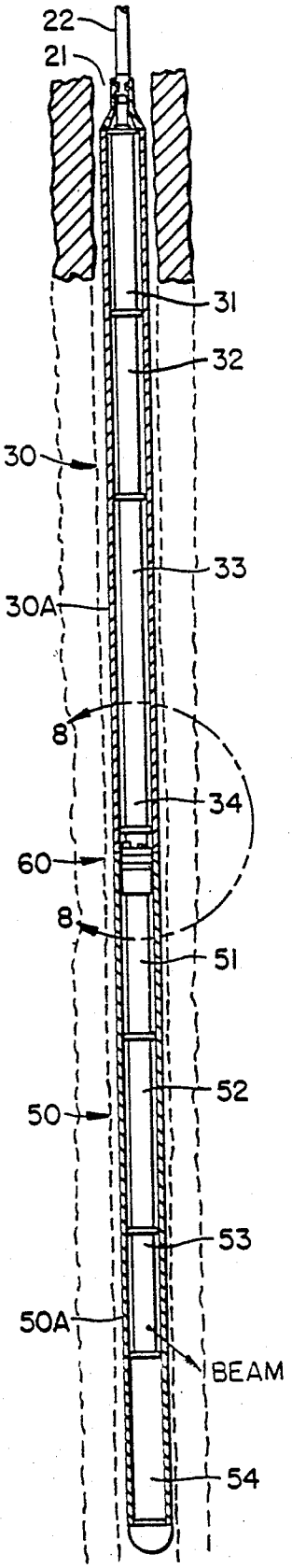
FIG. 7 is a schematic elevational view, partially in section, illustrating an operative embodiment of the present invention.

Referring now to FIG. 7, there is shown a schematic elevational view of a compact, well logging instrument in accordance with the present invention for suspension in a borehole 21, (typically less than nine inches in diameter) by means of an armored multiconductor cable 22, which includes communication cables for transferring appropriate power and control signals to the well logging instrument in the borehole 21 and transmitting information obtained from detectors in the well logging instrument to recording and analyzing equipment on the earth's surface. The well logging instrument includes a fluid tight housing having an outer diameter not exceeding 5 inches, and comprises two principal components, a resonant charging, linetype modulator sonde 30 and a linear accelerator and detector sonde 50 interconnected by a multi-pin field joint 60 containing a HV coaxial connector assembly 70. The modulator sonde includes a telemetry interfaced control and auxiliary power module 31, a resonant charge module 32, a pulse forming network 33 and a high voltage switch module 34. The linear accelerator sonde 50 contains a pulse transformer module 51, an RF generator and accelerator waveguide module 52, a particle beam bending module 53 and a nuclear radiation detection equipment module 54.

By the provision of distinct modular elements in two or more sonde sections, an elongate instrument can be provided that can be disconnected for shipment in short sections to the operating site.

Figure 8:
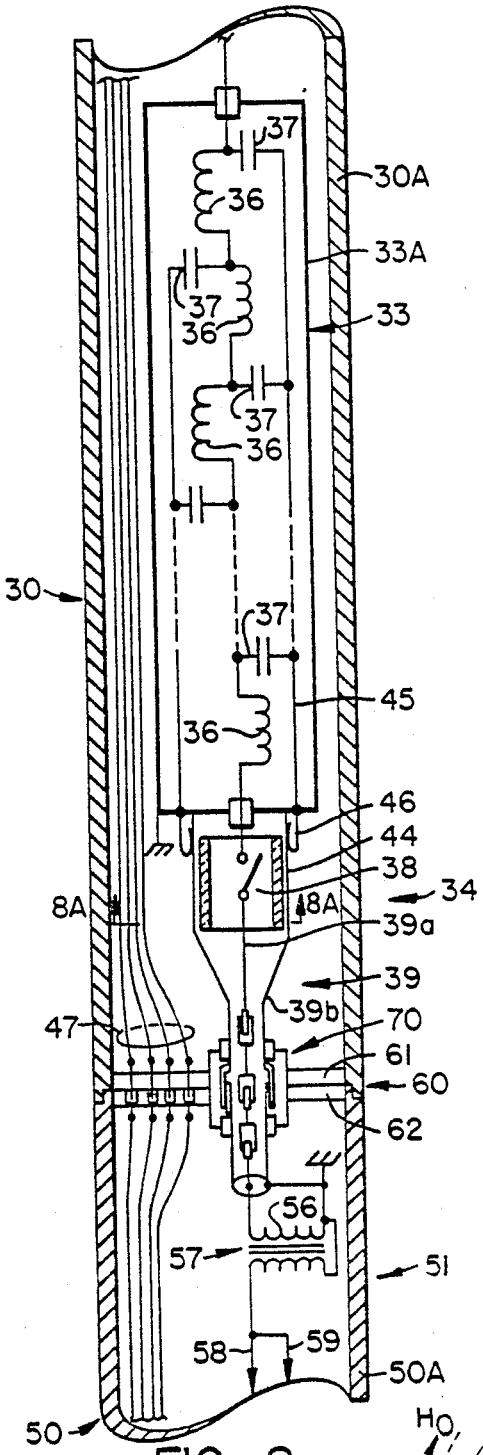
FIG. 8 is an enlarged longitudinal sectional view of a portion of the structure shown in FIG. 7 delineated by line 8—8.

Referring now to FIG. 8, the adjacent portions of the modulator sonde 30 and the linear accelerator sonde 50 are shown in greater detail to disclose that within respective fluid tight housings 30A and 50A the pulse forming network (PFN) 33, comprising inductors 36 and HV pulse capacitors 37 coaxially mounted and shielded within a metal enclosure 33A to reduce EMI, is connected to the primary winding 56 of a step-up pulse transformer 57 in module 51 via an HV switch 38 and a coaxial transmission line 39 which passes through a field joint HV coaxial connector assembly 70. This assembly is shown in greater detail in FIGS. 9 and 9A. The secondary outputs 58 and 59 of the pulse transformer 57 are connected to the accelerator electron gun 6 and the RF source 10, respectively, as shown in FIG. 10. The pulse current loop path between the PFN and the pulse transformer is arranged such that the current in the outer conductor 39*b* of the transmission line 39 as well as the interconnecting cylindrical metal shield 44, surrounding the ceramic envelope of the HV switch 38, flows in a direction opposite to that of the current flowing through the HV switch 38 and the inner conductor 39*a* of the transmission line 39. The outer conductive shield 44, surrounding the HV switch 38, is attached to the common circuit 45 of the PFN capacitors by a series of spring loaded metal fingers 46 arranged to provide good electrical contact while at the same time permitting easy removal of the shield 44 for convenient access to the HV switch 38. Such an arrangement effectively reduces electromagnetic interference due to both electric and magnetic field radiation, and permits control cables 47 and sensitive electronics to operate satisfactorily in very close proximity to the HV switch 38 and associated high power interconnections.

Figure 8A:
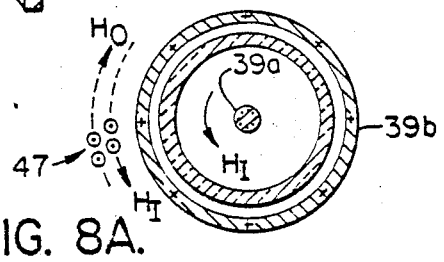
FIG. 8A is a schematic cross-sectional view along line 8A—8A in FIG. 8 illustrating the magnetic field cancellation feature of this invention.

FIG. 8A shows a cross-sectional view, along the FIG. 8 line 8A—8A, through the HV coaxial transmission line 39 and HV switch 38 illustrating how, in the region outside of the coaxial assembly, the contraflow current in the outer conducting shield generates a magnetic field $H_O$ which cancels the magnetic field $H_I$ radiated from the inner conductor. It should be noted that in this embodiment, the HV inner conductor is effectively grounded at both ends. Therefore, to cancel externally radiated magnetic fields, the outer conductive shield must also be grounded at both ends; and good continuity should be maintained along the full length of the high power transmission line. These requirements are satisfied, and a highly advantageous demountable interface between the modulator and accelerator sondes is made possible, by the multiple sliding joint, HV coaxial connector assembly 70 disclosed in FIGS. 9 and 9A.

Figure 9A:
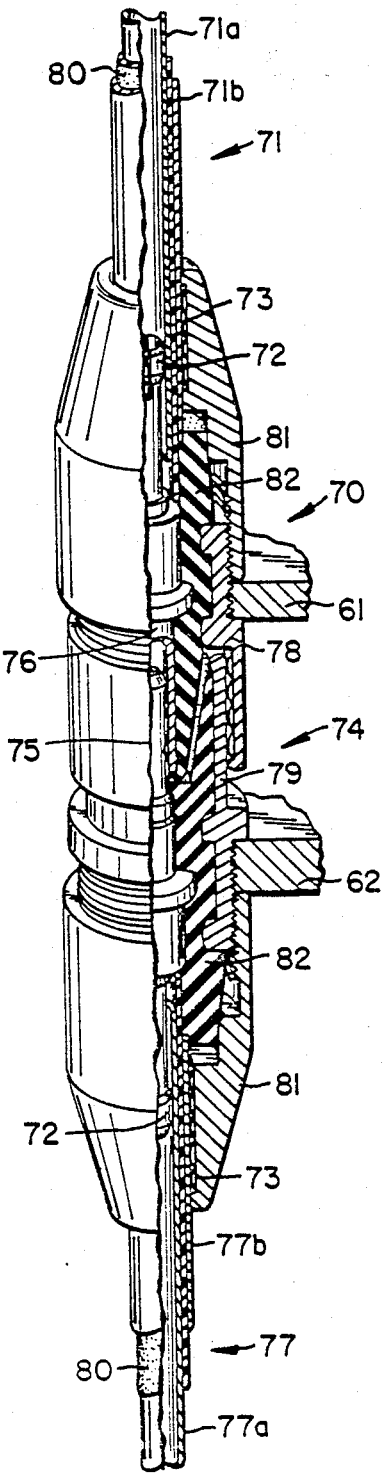
FIG. 9A is a perspective elevational view, partially broken away, of the field joint coaxial connector assembly of the present invention.
Figure 9:
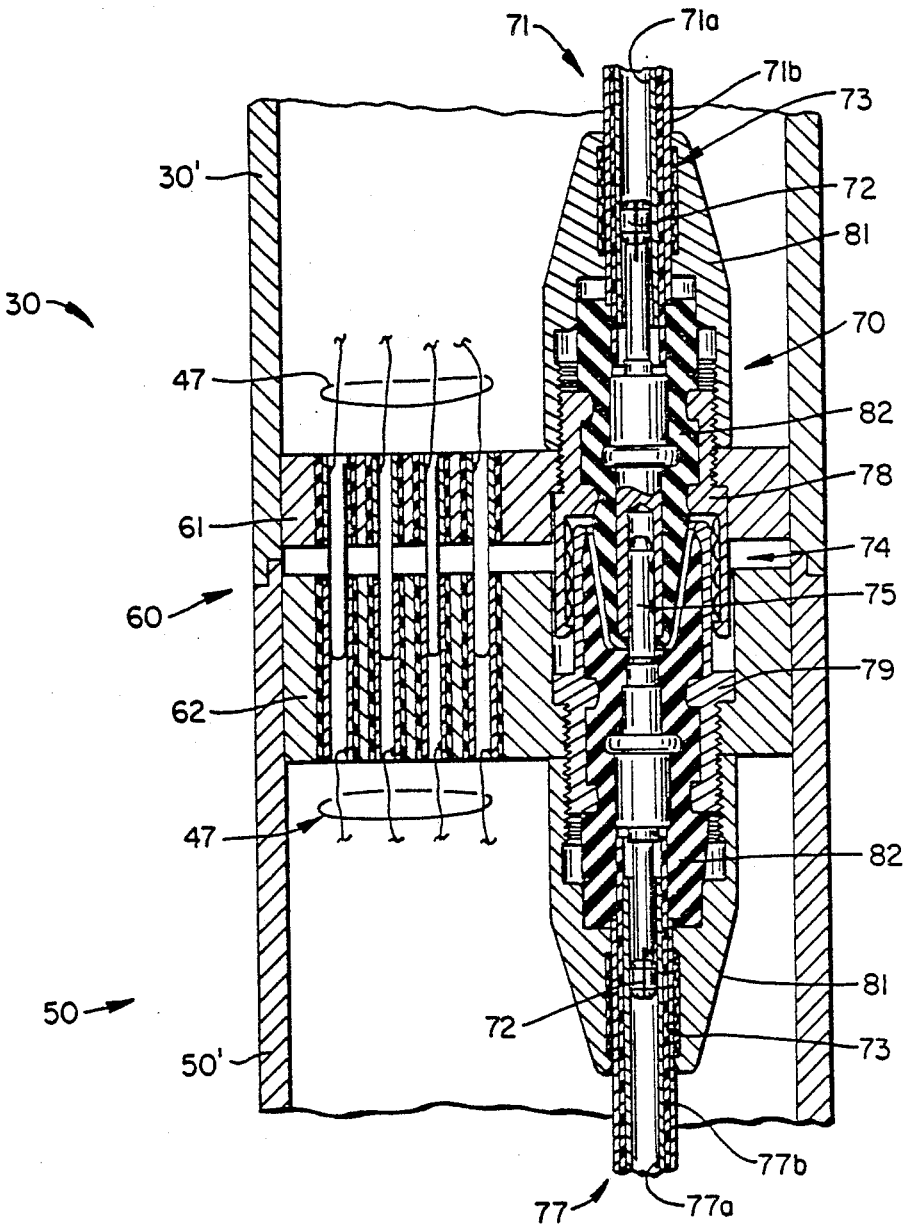
FIG. 9 is an enlarged, cross-sectional, elevational view of the field joint in a well logging instrument in accordance with this invention.
Figure 10:
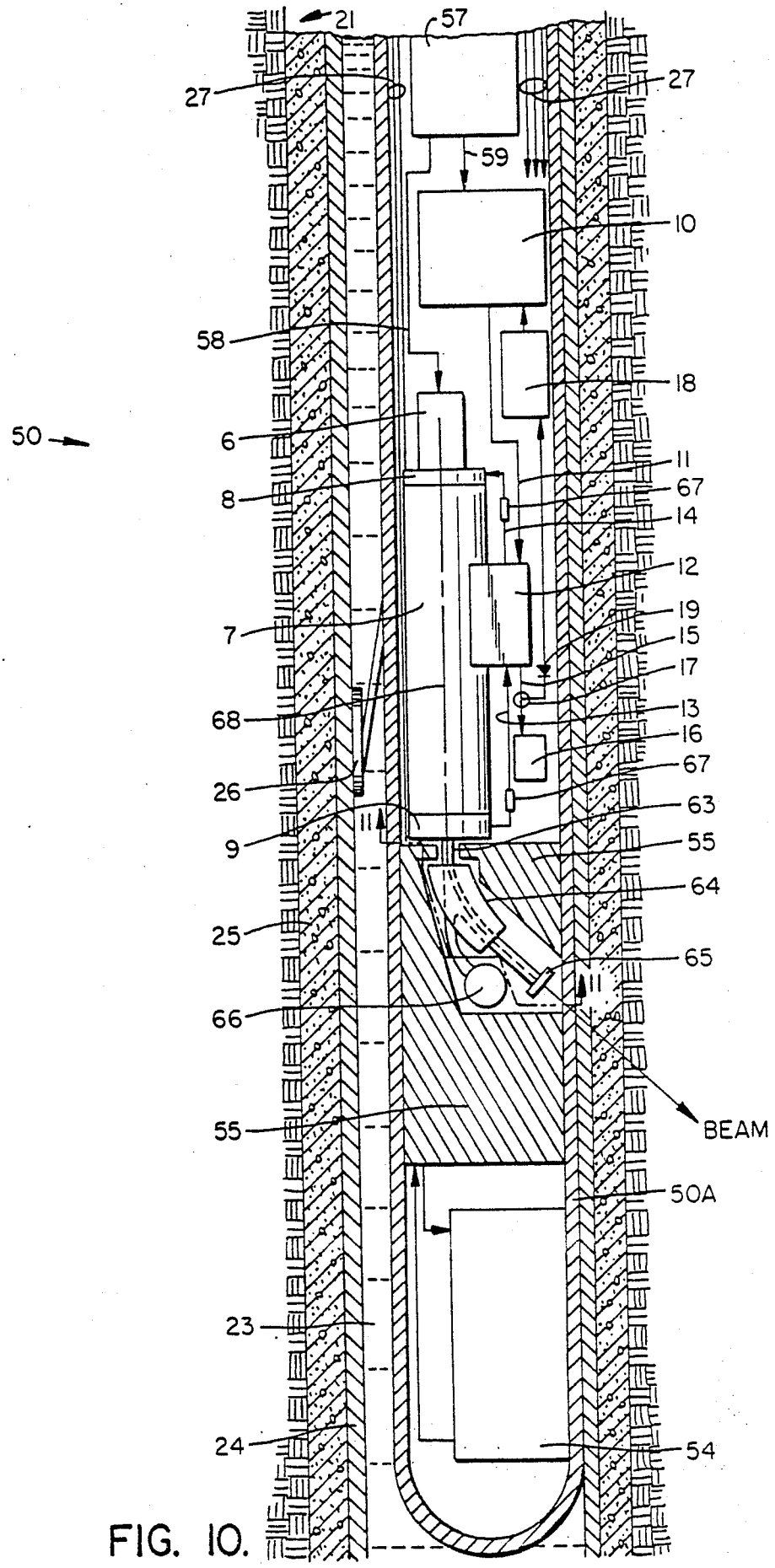
FIG. 10 is a schematic elevational view, partially in block diagram form, of a portion of the structure shown in FIG. 7.

FIG. 9 shows a cross-sectional elevation, and FIG. 9A a partial cross-section perspective elevation, of the field joint HV coaxial connector assembly 70 comprising an incoming coaxial transmission line 71 with inner and outer sliding joint connections 72 and 73, respectively, at the terminations of the inner and outer tubular conductors 71*a* and 71*b* of transmission line 71; a main field joint coaxial connector 74 having inner conductor sliding joint 75–76 and outer conductor sliding joint 78–79; and an exiting coaxial transmission line 77 with inner and outer sliding joint connections 72 and 73, respectively, with the inner and outer conductors 77*a* and 77*b* of transmission line 77.

The field joint 60 comprises a multi-pin bulkhead 61 forming the lower head of the modulator sonde 30 and a mating multi-socket bulkhead 62 forming the upper head of the accelerator and detection equipment sonde 50. The HV coaxial connector assembly 70 is held at the field joint 60 by a female dual connector 78 and a mating male dual connector 79 fastened into apertures in the bulkheads 61 and 62, respectively, using nickel plated, threaded aluminum clamp assemblies 81 engaging threads on the upper end of female connector 78 and on the lower end of male connector 79.

A simple guide pin arrangement is used to correctly align the multi-pin connections during closure of the field joint 60; and closure is maintained during operation, regardless of thermal expansion and contraction, by a compression spring (not shown) located between the field joint bulkhead 62 and the accelerator assembly within the sonde 50.

The coaxial connector HV inner conductor pin 75 and socket 76 joint components are constructed from silver plated, beryllium copper and are potted into the connector bodies 79 and 78, respectively, using a high curing temperature, silicone compound 82 in a manner well known to practitioners of the art. The distal terminations 72 of these inner conductor HV components comprise shaped spring fingers which make deeply engaged, firm sliding contacts with the inner diameter of the nickel plated, copper tubes forming the HV inner conductors 71*a* and 77*a* of the entering and exiting coaxial transmission lines 71 and 77. Similarly, the extremities of the clamp nut assemblies 81 form sliding connections 73 with the outer surfaces of the nickel plated copper tubes forming the outer conductors 71*b* and 77*b* of the entering and exiting coaxial transmission lines 71 and 77. It should be noted that the electrical connections at all six sliding joints (71*a*–72, 71*b*–73, 75–76, 78–79, 73–77*b*, 72–77*a*) described above are established and maintained by spring loaded metal finger contacts contained within the interspace of each joint.

It can be recognized that the HV coaxial connector assembly 70 disclosed above comprises, not only a dual sliding joint quick disconnect arrangement 75–76 and 78–79 enabling a field joint to be located between the modulator and accelerator sondes 30 and 50 to assist transportation and field assembly, but also a dual sliding connection 71*a*–72 and 71*b*–73 with the coaxial line 71 entering the field joint from the HV switch and PFN, and another dual sliding connection 72–77*a* and 73–77*b* with the exiting coaxial transmission line 77 connecting the field joint assembly to the input of the pulse transformer. In addition to providing a rapid and economic assembly means, the transmission line sliding joints allow large differential longitudinal movements to take place between the fluid-tight metal pressure housing and the accelerator equipment contained therein. This feature avoids damage due to adverse high temperature gradients that can develop during and after logging operation. For example, the spacing between the pulse transformer module 51 and the field joint bulkhead 62 would be reduced by approximately ¼" if a long, thick wall pressure housing were extracted immediately after deep well logging and then subjected to a freezing ambient temperature while the equipment inside the housing still retained a substantial fraction of the operational high ambient temperature rise.

The dual sliding joint concept disclosed above allows the use of a wide range of conductor dimensions. Since the ratio of the diameters of the outer and inner conductors and the choice of dielectric constant (of the insulation 80 separating the conductors) determines the characteristic impedance and power handling capability of a coaxial line, the field joint connector assembly 70 shown in FIGS. 9 and 9A can readily accommodate transmission lines to suit a wide range of modulator specifications. Flexibility in the choice of conductor dimensions also assists in more effectively reducing magnetic field interference by ensuring that the current flowing in the outer conductor will closely approach that of the inner conductor, when the outer conductor shield cut-off frequency is chosen to be considerably less than the frequency of the interfering magnetic field; i.e., the outer conductor will provide a lower impedance return path than that of the ground plane, due to the mutual inductance between conductors.

Referring now to FIG. 10, the linear accelerator sonde 50 contained in a fluid tight housing 50A is shown suspended in a borehole 21 which may be filled with drilling mud or other fluid 23, and it may be uncased or cased as indicated by metal casing 24 and concrete 25. The housing is shown pressed against the casing 24 by an eccentering thrust pad 26 to maintain a reasonably consistent irradiation geometry during the well logging survey. The borehole accelerator sonde 50 is shown in greater detail to disclose the pulse transformer 57 high voltage secondary winding dual outputs 58 and 59 connected to the accelerator electron gun 6 and the frequency tunable RF source 10, respectively. Such source can be a high gain, permanent magnet focused, X-band klystron amplifier constructed to operate independent of external cooling and driven by a temperature hardened, electronically tuned, solid state oscillator. The accelerator electron gun 6 is integrally attached to the RF input coupler at the input end 8 of the accelerator waveguide 7, and remnant RF power is extracted via an RF output coupler from the output end 9 of the accelerator waveguide 7 for feedback to an RF bridge 12 in a manner to be described in greater detail below. The accelerator waveguide is a suppressed phase oscillation, tapered phase velocity, high group velocity structure comprising a plurality of coupled cavities constructed such as to provide RF focusing (during initial stages of the beam trajectory) and to enable operation at a free floating temperature independent of external cooling. The outside diameter of this X-band accelerator waveguide 7 is less than two inches. The design and construction of accelerator waveguides are described in the aforementioned publication edited by Lapostolle et al. The beam optics design of suppressed phase oscillation accelerator waveguides is described in applicant's articles of 1962, 1965*a* and 1966*a* listed on page 469 of that publication and will be apparent to those skilled in the art. Interconnecting cables 27 for connecting other components of the well logging instrument are only partially and schematically illustrated.

A beam tube 63 is provided for the accelerated particle beam at the output end 9 of the accelerator waveguide 7, and a magnetic beam bending system 64 is positioned around the beam tube 63 to focus and bend the beam for passage through an electron window 65 and impaction upon a target to generate the desired radiation. In a manner familiar to practitioners of the art, the accelerator waveguide vacuum system is sealed and terminated with RF and electron beam windows, and a high vacuum condition is monitored and maintained with an electronic vacuum pump 66.

The accelerator waveguide module and the beam bending module are separated from the nuclear radiation detection equipment module 54 by radiation shielding 55 to prevent direct exposure of the detection equipment to unacceptable levels of nuclear radiation. The generation of various types of radiation and detection thereof is outside the scope of the present invention and can be better appreciated from a review of the Green and Turcotte patents referenced above.

A first directing means, or waveguide 11, is provided for directing microwave energy from an RF source 10 to an RF bridge 12 assembled in close proximity to the accelerator waveguide 7; and another directing means, or waveguide 13, is provided for directing RF energy extracted from the output end 9 of the accelerator waveguide 7 to a third input arm of the RF bridge 12. Yet another directing means, or waveguide 14, is provided at a second arm of the RF bridge 12 for directing from the bridge to the input end of the accelerator waveguide 7, both the energy directed to the bridge from the RF source by waveguide 11 and the extracted energy from the accelerator waveguide introduced into the bridge 12 by waveguide 13. A fourth directing means, or waveguide 15, is provided for a fourth port of the bridge 12 and is connected to an RF load 16. When remnant energy extracted from the accelerator 7 and directed to the bridge 12 by waveguide 13 is not correctly phased with respect to the energy arriving at the bridge from the RF power source 10 via waveguide 11, the bridge will be in an unbalanced condition, and energy will pass into the fourth waveguide 15 where its presence will be detected by the RF power monitor 17. The bridge balance processor 18 receives a video signal from the diode detector 19 monitoring the power level in the load arm 15, and provides a control voltage that adjusts the frequency of the RF source 10 until the power level in the load arm 15 is reduced to essentially zero. The bridge is thereby restored to the balanced condition. That is, the monitor signal from the bridge load arm 15 is used to control the system frequency so that the level of unbalanced RF power is always driven toward, or maintained at, a minimum. Thus, both the overall electrical length of the feedback loop and the beamwave phase relationship in the accelerator waveguide are maintained essentially constant. This results in stable beam performance over an extreme range of operating temperatures, in the manner disclosed hereinabove.

It will be appreciated that no moving parts such as movable phase shifters and their requisite drive motors are necessary with the present invention.

It will also be appreciated that the present invention enables the use of an uncooled accelerator structure as well as an uncooled RF source because the correct operating frequency is automatically established by balancing the RF bridge, so that conventional temperature stabilization and temperature sensing of critical components is no longer necessary.

In order to maintain the exact overall electrical length of the feedback loop as well as the optimum beam-wave phase relationship in the accelerator waveguide while operating the accelerator over a wide range of temperatures, utilizing the travelling wave resonant ring control method and apparatus in accordance with this invention requires that a specific physical condition be permanently established within the feedback loop during initial construction and operation of the accelerator system. In practice, this has been successfully accomplished by constructing the feedback loop components, including the final nodal tuned accelerator structure, from a design calculated to produce a total loop phase shift within approximately 20 or 30 degrees of the desired optimum value ($2m\pi$), when the system is operated at a given ambient temperature, say, 60° C. and the corresponding design frequency to produce a near optimum beam performance. Then, with the accelerator operating under manual frequency control and with the frequency tuned to produce optimum beam performance, the RF bridge 12 is accurately balanced with a final and permanent adjustment of the feedback loop phase length by a permanent deformation of deformable waveguide sections 67 in waveguides 13 and/or 14. Thereafter, when the system is introduced into operation in the field, the bridge balance frequency control automatically provides a simple phase lock means, as described hereinabove, that maintains a constant beam performance by accurately holding constant the electrical length of both the accelerator waveguide and the feedback loop, regardless of extremely wide temperature variations (<100° C.). This free floating temperature capability permits operation of the accelerator system without external cooling. When the accelerator is switched on in the field at a random ambient temperature, the broad band characteristics of the system allow the frequency to be rapidly tuned to the correct operating value without monitoring the temperature of the accelerator structure or any of the other feedback loop components. From FIG. 4A and the above disclosed phasetemperature data, it can be noted that to ensure correct convergence of the automatically tuned frequency at switch on, the maximum permissible initial loop phase error $\Delta\phi$, not exceeding $\pm\pi$, corresponds to a temperature difference (between standby and operation) of approximately ±30 to ±60° C. over a range of increasing frequency values for practical accelerator systems. In one embodiment of this invention, frequency convergence conditions are readily achieved by simply arranging, whenever the accelerator is in the standby condition (not beaming), for the frequency to revert to a value dependent on the ambient temperature at a convenient location in the sonde, e.g., at the chassis of the bridge balance processor.

Figure 11:
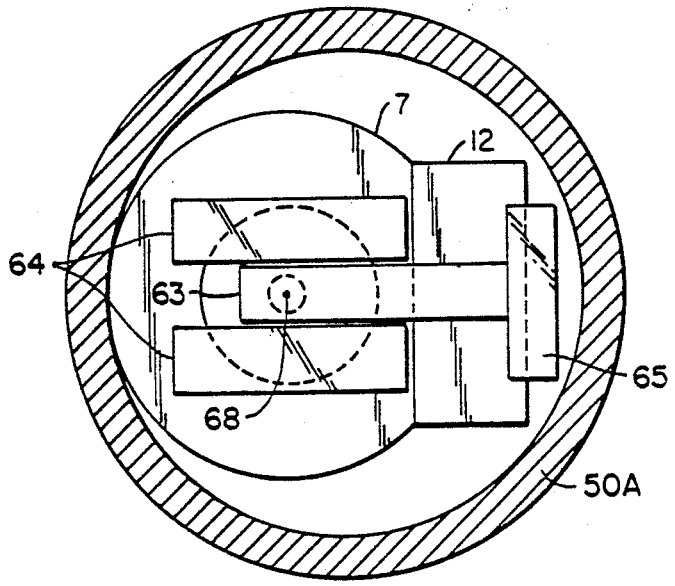
FIG. 11 is a cross-sectional view of a portion of the structure shown in FIG. 10 taken along line 11—11 in the direction of the arrows.
Figure 12:
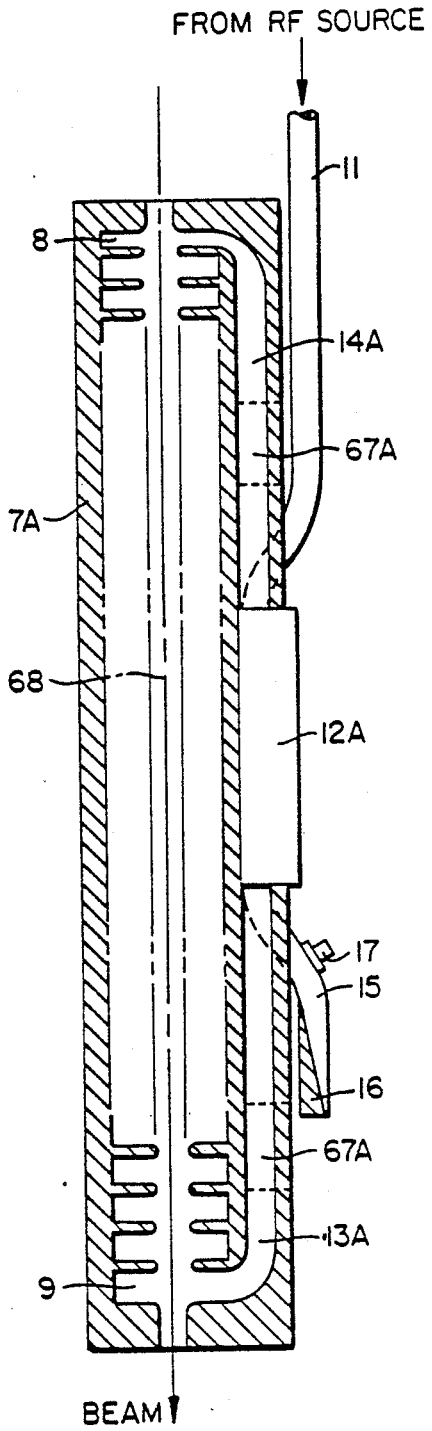
FIG. 12 is a schematic elevational sectional view of an alternative embodiment of the present invention.

The undesirable effect of an intra-loop temperature difference, as discussed previously, is avoided by positioning the RF bridge 12 and the interconnecting waveguides 13 and 14 in close proximity to the accelerator waveguide 7, as disclosed in FIGS. 10 and 11. FIG. 11 is a cross-sectional end view of a portion of the structure shown in FIG. 10. This view, taken along line 11—11 in the direction of the arrows, shows the RF bridge 12 positioned against the side of the accelerator waveguide 7. FIG. 11 also indicates the orientation of the beam tube 63, beam bending magnets 64, and electron window and target assembly 65, with respect to the accelerator beam centerline 68 and the accelerator housing 50A. Yet another embodiment of this invention, as disclosed in FIG. 12, shows the interconnecting waveguides 13A and 14A, including deformable waveguide sections 67A, machined and brazed integrally with the accelerator structure 7A and the RF bridge 12A, to provide a uniform temperature, highly compact, resonant ring configuration. Waveguides 14A and 13A are connected to the input and output ends 8 and 9, respectively of the accelerator waveguide via smooth waveguide transitions, of oval cross section, having small bending radii in the plane of the electric field to provide broadband characteristics as also typically used in the embodiment of FIG. 10.

As discussed in the hereinabove description of travelling wave resonant ring systems, due to buildup, a higher RF power level than is available from the RF source can be established at the accelerator input. In one typical embodiment, it is possible to have a 2 to 1 RF power buildup while having a 50 percent loss of power within the feedback loop due to beam loading and copper losses. With this RF power build-up technique, it is possible thereby to achieve a given beam energy and current with less sensitivity to frequency and temperature variations, and with a smaller RF generator, and consequently a smaller modulator, than that of a non-resonant ring accelerator. This makes the accelerator and modulator in accordance with the present invention particularly advantageous for use in borehole applications where high ambient temperatures are encountered and where the available space is critically limited by the borehole diameter (typical borehole casings range in diameter from five to nine inches).

Several major advantages are offered by the well logging instrument disclosed herein as compared with radioactive isotopes, such as cobalt 60 and radium 226, or cesium 137 as presently used in commercial logging operations. A principle advantage is that the intensity of the photon beam produced by this linear accelerator is several orders of magnitude greater than that available from the presently used isotopic photon sources. Consequently, faster logging speeds and improved depth of investigation of the formation are made possible by substantially increased detector counting rates. Moreover, unlike a linear accelerator that can be turned off when not in use, continuously emitting radioactive isotopes present an inadvertent exposure risk to the public, as well as to operating personnel, in the event of fire or accident during transportation, handling and storage; and loss or damage of a radioisotope during logging operations could result in ground water contamination. Yet another operational advantage of the linear accelerator is that both the peak intensity and the repetition rate of the pulsed radiation output can be conveniently controlled.

A borehole linear accelerator in accordance with the embodiment of the present invention when operating with a total input power of less than 500 watts produces a central axis photon intensity of greater than 5000 R/min at the incident wall of the borehole.

While the apparatus and method of this invention have been described with respect to preferred embodiments, it is to be recognized that numerous modifications and variations of this structure and method, all within the scope of this invention, will become readily apparent to those skilled in the art. Accordingly, the foregoing descriptions of the preferred embodiments are to be considered illustrative only of the principles of the invention and are not to be considered limitative thereof. The scope of this invention is to be limited solely by the claims appended hereto.

I claim:

1. The method of accelerating a particle beam in a particle accelerator comprising the steps of:

generating radio frequency energy of a given frequency, injecting the generated radio frequency energy in one arm of a radio frequency bridge network, injecting remnant radio frequency energy from the output of the accelerator in a third arm of the bridge network, directing the source energy and the accelerator remnant energy to the input of the accelerator via a second arm of the bridge network, directing bridge network imbalance energy to a load via a fourth arm of the bridge network, detecting the level of energy imbalance in the fourth arm of the bridge network, changing the given frequency of the generated energy in response to the detected energy imbalance to maintain the energy imbalance in the fourth arm at a minimum.

2. The method of accelerating a particle beam in a particle accelerator comprising the steps of:

generating radio frequency energy of a given frequency, accelerating charged particles to high energy levels with said generated energy and with remnant energy remaining after said accelerating step, combining said generated energy and said remnant energy in a radio frequency bridge balanced for said acceleration step, and automatically controlling said given frequency to maintain the bridge balanced.

3. The method of accelerating a particle beam in a particle accelerator comprising the steps of:

generating radio frequency energy of a given frequency at a free floating temperature independent of an external cooling system, accelerating charged particles to high energy levels with said generated energy and with remnant energy remaining after said accelerating step, combining said generated energy and said remnant energy in a balanced bridge to maximize input energy for said acceleration step, allowing the accelerator waveguide of said particle accelerator to operate at a free floating temperature independent of an external cooling system, and controlling said given frequency to maintain the bridge balanced to provide the correct beamwave phase relationship during said acceleration step and to compensate for temperature induced dimensional changes in the particle accelerator and radio frequency generator.

4. Apparatus for accelerating a particle beam in a particle accelerator comprising:

means for generating radio frequency energy of a given frequency, a travelling wave accelerator means for accelerating a particle beam from an input end to an output end, radio frequency bridge network means, first waveguide means for directing radio frequency energy from said generating means into one arm of said bridge network means, third waveguide means for directing remnant radio frequency energy from the output end of said accelerating means into a third arm of said bridge network means, second waveguide means for directing energy from both said first and third arms of said bridge network means to said input of said accelerator means from a second arm of said bridge network means, fourth waveguide means for directing unbalanced energy in said network means to a load from a fourth arm of said bridge network means, means for detecting the level of energy imbalance in said fourth waveguide means, and means for changing said given frequency of said generating means in response to the energy imbalance detected by said detecting means for maintaining the energy imbalance at a minimum in said fourth waveguide means.

5. The apparatus of claim 4 wherein said accelerator means, said second and third waveguide means, and said bridge means are mounted in close proximity to one another to stabilize all of said means at substantially the same temperature.

6. The apparatus of claim 4 wherein said accelerator means, said second and third waveguide means, and said bridge means are mounted in contact with one another to stabilize all said means at substantially the same temperature.

7. The apparatus of claim 4 wherein said accelerator means, said second and third waveguide means, and said bridge means are integral with one another.

8. The apparatus of claim 4 wherein said accelerator means includes a metallic accelerating waveguide means for conducting heat throughout to operate at a free floating temperature independent of any external cooling system.

9. The apparatus of claim 4 wherein said radio frequency generating means includes a tunable oscillator driver and a permanent magnet focused klystron amplifier constructed to operate independent of any external cooling system.

10. The apparatus of claim 4 wherein said accelerator means is constructed to provide radio frequency focusing of the particle beam during initial stages of the beam trajectory.

11. Apparatus for accelerating a particle beam in a particle accelerator comprising:

source means for generating radio frequency energy of a given frequency, accelerator means for accelerating a particle beam from an input end to an output end, means for directing source energy from said generating means into the input end of said accelerator means, means for directing remnant energy from the output end of said accelerator means into the input end of said accelerator means, bridge means for combining source energy and remnant energy for directing and maximizing combined energy into said accelerator means and for maintaining the beam-wave phase relationship within said accelerator means when said bridge means is balanced, and means for controlling said given frequency of said source energy means to maintain said bridge means balanced.

12. The apparatus of claim 11 wherein said accelerator means includes a metallic accelerating waveguide means for conducting heat throughout to operate at a free floating temperature independent of any external cooling system.

13. The apparatus of claim 11 wherein said radio frequency generating means includes a tunable oscillator driver and a permanent magnet focused klystron amplifier constructed to operate independent of any external cooling system.

14. The apparatus of claim 11 wherein said accelerator means is constructed to provide radio frequency focusing of the particle beam during initial stages of the beam trajectory.

15. In a multiple housing linear accelerator having a first elongate member and a second elongate member joined end to end, a high voltage coaxial connector assembly interconnecting first and second coaxial lines in said first and said second elongate members, respectively, said connector assembly including first inner and outer sliding joint means for making sliding contact with the inner and outer conductors, respectively, of said first coaxial line in said first elongate member, second inner and outer sliding joint means for making sliding contact with the inner and outer conductors, respectively, of said second coaxial line in said second elongate member, third inner and outer conductors connected, respectively, to said first inner and outer portions of said first sliding joint means and mounted at the end of said first elongate member adjacent said second elongate member, and fourth inner and outer conductors connected, respectively, to said second inner and outer portions of said second sliding joint means and mounted at the end of said second elongate member adjacent said first elongate member, said third inner and outer conductors adapted for making sliding contact with said fourth inner and outer conductors, respectively, whereby said elongate members can be assembled and disassembled and allowance is provided for longitudinal movement of internal parts of said elongate members while maintaining stress free electrical interconnection when said elongate members are joined.

16. In a linear accelerator in accordance with claim 15, pulse forming network means, pulse transformer means, high voltage switch means connected in circuit between said network means and said transformer means, and a metal shield means surrounding said switch means and electrically connecting said network means to said transformer means for avoiding electromagnetic interference due to pulse high current flowing through said switch means.

17. In a linear accelerator system, pulse forming network means, pulse transformer means, high voltage switch means connected in circuit between said network means and said transformer means, and a metal shield means surrounding said switch means and electrically connecting said network means to said transformer means for avoiding electromagnetic interference due to pulsed high current flowing through said switch means.

18. A borehole compatible linear accelerator system comprising:

a first elongate modulator member, a second elongate linear accelerator member, said first and second elongate members adapted to be joined end to end to form the linear accelerator system, a pulse forming network in said first elongate member, a pulse transformer means in said second elongate member, high voltage switch means connected in circuit between said network means and said transformer means, a metal shield means for avoiding electromagnetic interference, said shield means surrounding said switch means and electrically connecting said network means to said transformer means, said second elongate member including means for generating radio frequency energy of a given frequency, travelling wave accelerator means for accelerating a particle beam from an input end to an output end, radio frequency bridge network means, first waveguide means for directing radio frequency energy from said generating means into one arm of said bridge network means, third waveguide means for directing remnant radio frequency energy from the output end of said accelerator means into a third arm of said bridge network means, second waveguide means for directing energy from both said first and third arms of said bridge network means to said input of said accelerator means from a second arm of said bridge network means, fourth waveguide means for directing unbalanced energy in said network means to a load from a fourth arm of said bridge network means, means for detecting the level of energy imbalance in said fourth waveguide means, and means for changing said given frequency of said generating means in response to the energy imbalance detected by said detecting means for maintaining the energy imbalance at a minimum in said fourth waveguide means.

19. The apparatus of claim 18 wherein said accelerator means, said second and third waveguide means, and said bridge means are mounted in close proximity to one another to stabilize all of said means at substantially the same temperature.

20. The apparatus of claim 18 wherein said accelerator means, said second and third waveguide means, and said bridge means are mounted in contact with one another to stabilize all said means at substantially the same temperature.

21. The apparatus of claim 18 wherein said accelerator means, said second and third waveguide means, and said bridge means are integral with one another.

22. The apparatus of claim 18 wherein said accelerator means includes a metallic accelerating waveguide means for conducting heat throughout to operate at a free floating temperature independent of any external cooling system.

23. The apparatus of claim 18 wherein said radio frequency generating means includes a tunable oscillator driver and a permanent magnet focused klystron amplifier constructed to operate independent of any external cooling system.

24. The apparatus of claim 18 wherein said accelerator means is constructed to provide radio frequency focusing of the particle beam during initial stages of the beam trajectory.

25. A borehole compatible linear accelerator system comprising:

a first elongate modulator member, a second elongate linear accelerator member, said first and second elongate members adapted to be joined end to end to form the linear accelerator system, a pulse forming network in said first elongate member, a pulse transformer means in said second elongate member, high voltage switch means connected in circuit between said network means and said transformer means, a high voltage coaxial connector assembly at the joint between said first and second elongate members for interconnecting a first coaxial line connected to said switch means in said first elongate member and a second coaxial line connected to said pulse transformer means in said second elongate member, said connector assembly including first inner and outer sliding joint means for making sliding contact with the inner and outer conductors, respectively, of said first coaxial line in said first elongate member, second inner and outer sliding joint means for making sliding contact with the inner and outer conductors, respectively, of said second coaxial line in said second elongate member, third inner and outer conductors connected, respectively, to said first inner and outer portions of said first sliding joint means and mounted at the end of said first elongate member adjacent said second elongate member, fourth inner and outer conductors connected, respectively, to said second inner and outer portions of said second sliding joint means and mounted at the end of said second elongate member adjacent said first elongate member, said third inner and outer conductors adapted for making sliding contact with said fourth inner and outer conductors, respectively, said second elongate member including means for generating radio frequency energy of a given frequency, travelling wave accelerator means for accelerating a particle beam from an input end to an output end, radio frequency bridge network means, first waveguide means for directing radio frequency energy from said generating means into one arm of said bridge network means, third waveguide means for directing remnant radio frequency energy from the output end of said accelerator means into a third arm of said bridge network means, second waveguide means for directing energy from both said first and third arms of said bridge network means to said input of said accelerator means from a second arm of said bridge network means, fourth waveguide means for directing unbalanced energy in said network means to a load from a fourth arm of said bridge network means, means for detecting the level of energy imbalance in said fourth waveguide means, and means for changing said given frequency of said generating means in response to the energy imbalance detected by said detecting means for maintaining the energy imbalance at a minimum in said fourth waveguide means.

26. The apparatus of claim 25 wherein said accelerator means, said second and third waveguide means, and said bridge means are mounted in close proximity to one another to stabilize all of said means at substantially the same temperature.

27. The apparatus of claim 25 wherein said accelerator means, said second and third waveguide means, and said bridge means are mounted in contact with one another to stabilize all said means at substantially the same temperature.

28. The apparatus of claim 25 wherein said accelerator means, said second and third waveguide means, and said bridge means are integral with one another.

29. A linear accelerator system in accordance with claim 25 including a metal shield means for avoiding electromagnetic interference, said shield means surrounding said switch means and electrically connecting said pulse forming network means to said pulse transformer means.

30. The apparatus of claim 25 wherein said accelerator means includes a metallic accelerating waveguide means for conducting heat throughout to operate at a free floating temperature independent of any external cooling system.

31. The apparatus of claim 25 wherein said radio frequency generating means includes a tunable oscillator driver and a permanent magnet focused klystron amplifier constructed to operate independent of any external cooling system.

32. The apparatus of claim 25 wherein said accelerator means is constructed to provide radio frequency focusing of the particle beam during initial stages of the beam trajectory.

* * * * *